US011440072B2

(12) United States Patent
Kennedy et al.

(10) Patent No.: US 11,440,072 B2
(45) Date of Patent: Sep. 13, 2022

(54) TUBE BENDING MANDREL AND SYSTEM USING THE SAME

(71) Applicant: Carrier Corporation, Palm Beach Gardens, FL (US)

(72) Inventors: Jon P. Kennedy, Syracuse, NY (US); Luis Felipe Avila, Manlius, NY (US); Michael W. Samko, Collierville, TN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 266 days.

(21) Appl. No.: 16/831,294

(22) Filed: Mar. 26, 2020

(65) Prior Publication Data

US 2020/0306811 A1 Oct. 1, 2020

Related U.S. Application Data

(60) Provisional application No. 62/825,460, filed on Mar. 28, 2019.

(51) Int. Cl.

| | |
|---|---|
| ***B21D 9/16*** | (2006.01) |
| ***B21D 9/04*** | (2006.01) |
| *B21D 53/06* | (2006.01) |

(52) U.S. Cl.

CPC ..... *B21D 9/16* (2013.01); *B21D 9/04* (2013.01); *B21D 53/06* (2013.01)

(58) Field of Classification Search

CPC ... B21D 9/01; B21D 9/04; B21D 9/05; B21D 9/07; B21D 9/10; B21D 9/12; B21D 9/16; B21D 9/165; B21D 7/022; B21D 7/03; B21D 11/07; B21D 53/06; B21D 39/20; B21D 41/026; B21C 3/16; B21C 37/15; B21B 17/02

See application file for complete search history.

(56) References Cited

U.S. PATENT DOCUMENTS

| | | | | |
|---|---|---|---|---|
| 4,459,917 | A | 7/1984 | Michael et al. | |
| 5,210,932 | A | 5/1993 | Tokura | |
| 8,037,595 | B2 | 10/2011 | Dees et al. | |
| 8,074,356 | B2 | 12/2011 | Branyon et al. | |
| 9,078,505 | B2 | 7/2015 | Skrypchaz et al. | |
| 9,403,202 | B2 | 8/2016 | Thomas et al. | |
| 9,511,408 | B2 | 12/2016 | Maggiolo | |
| 11,167,335 | B2 * | 11/2021 | Kawamoto | B21D 7/022 |

FOREIGN PATENT DOCUMENTS

| | | | | |
|---|---|---|---|---|
| CA | 2269138 | A1 * | 10/2000 | B21D 9/04 |
| CN | 101870913 | B | 3/2013 | |
| CN | 102728730 | B | 10/2014 | |
| CN | 103537573 | B | 4/2017 | |
| CN | 103537572 | B | 5/2017 | |
| JP | H0833935 | A | 2/1996 | |
| JP | 2008093713 | A | 4/2008 | |
| JP | 2012096273 | A | 5/2012 | |
| JP | 2015062951 | A | 4/2015 | |

* cited by examiner

*Primary Examiner* — Debra M Sullivan

(74) *Attorney, Agent, or Firm* — Cantor Colburn LLP

(57) ABSTRACT

Disclosed is a tube bending system for forming a hairpin tube, the tube bending system including: a supply of lubricant; a supply of atomizing medium; a bend mandrel, the bend mandrel comprising: a mandrel body and a mandrel head, the mandrel head being positionable within a length of a tube to be bent, the mandrel head including a downstream end with an orifice configured for injecting lubricant into the tube.

18 Claims, 4 Drawing Sheets

TUBE BENDING MANDREL AND SYSTEM USING THE SAME

CROSS-REFERENCE TO RELATED APPLICATIONS

This application claims the benefit of U.S. Provisional Application No. 62/825,460 filed Mar. 28, 2019, the disclosure of which is incorporated herein by reference in its entirety.

BACKGROUND

The present disclosure relates to a method and apparatus for applying a lubricant to a hairpin tube.

HVAC systems utilize aluminum or copper tubes to carry heat exchange fluid. In an evaporator or condenser of the HVAC system, the tubes may be arranged to meander back and forth in a serpentine pattern. At the bends of the serpentine pattern, a hairpin portion of the tube is present that, in general, is manufactured separately and then brazed to shorter sections of the tubes. Hairpins are expanded for proper tube to fin contact. Also, to ensure that the hairpin portion can be coupled to shorter sections of the tubes, the ends of the hairpin portions are expanded using an expansion device. Expansion lubricant needs to be applied to the inside of an aluminum hairpin tube prior to expanding the tube into the fin pack.

BRIEF SUMMARY

Disclosed is a tube bending system for forming a hairpin tube, the tube bending system comprising: a supply of lubricant; a supply of atomizing medium; a bend mandrel, the bend mandrel comprising: a mandrel body and a mandrel head, the mandrel head being positionable within a length of a tube to be bent, the mandrel head including a downstream end with an orifice configured for injecting lubricant into the tube.

In addition to one or more of the above disclosed features or as an alternate the mandrel includes the mandrel head and a mandrel body, the mandrel head is configured to swivel relative to the mandrel body.

In addition to one or more of the above disclosed features or as an alternate the mandrel body includes a first fluid passage, the mandrel head includes a second fluid passage, and a connecting tube extends therebetween for fluidly connecting the mandrel head and the mandrel body, the mandrel head being configured to swivel about the connecting tube.

In addition to one or more of the above disclosed features or as an alternate the system includes a system controller configured for: controlling a position of the mandrel disposed within a first end of the tube, the first end being an upstream end; controlling an injection of a first portion of lubricant from the supply of lubricant into the tube through the mandrel head; controlling motion of the mandrel or the tube so that the mandrel advances into the tube toward a second end of the tube, the second end being a downstream end, to thereby position the mandrel head at a bend zone in the tube; and controlling a bending the tube about the mandrel head to form the hairpin.

In addition to one or more of the above disclosed features or as an alternate the controller is further configured for: controlling an injection of a first portion of atomizing medium into the tube from the mandrel head before controlling the bending of the tube.

In addition to one or more of the above disclosed features or as an alternate the controller is further configured for: controlling the injection of the first portion of atomizing medium while controlling the advancement of the mandrel into the tube.

In addition to one or more of the above disclosed features or as an alternate the controller is further configured for: controlling an injection of a second portion of lubricant into the tube through the mandrel head prior to, during, or after controlling the bending of the tube and prior to controlling the retraction of the mandrel.

In addition to one or more of the above disclosed features or as an alternate the controller is further configured for: controlling an injection of a second portion of atomizing medium into the tube through the mandrel head after controlling the injection of the second portion of lubricant into the tube and prior to controlling the retraction of the mandrel.

In addition to one or more of the above disclosed features or as an alternate the controller is configured for controlling the advancement and retraction of the mandrel by: controlling a movement of the mandrel or the tube so that the mandrel moves relative to the tube; or controlling movement of the tube about the mandrel while the mandrel is fixedly positioned.

Further disclosed is method of forming a hairpin tube for a heat exchanger, the method comprising: positioning a mandrel head of a mandrel within a first end of a tube, the first end being an upstream end of the tube; injecting a first portion of lubricant axially into the tube through the mandrel head; advancing the mandrel into the tube toward a second end of the tube, the second end being a downstream end, to thereby position the mandrel head at a bend zone in the tube; and bending the tube about the mandrel head to form the hairpin.

In addition to one or more of the above disclosed features or as an alternate the method includes controlling motion of the mandrel or the tube so that mandrel is retracted from the tube.

In addition to one or more of the above disclosed features or as an alternate, the method includes injecting a first portion of atomizing medium into the tube from the mandrel head before bending the tube.

In addition to one or more of the above disclosed features or as an alternate, the method includes injecting the first portion of atomizing medium into the tube after injecting the first portion of lubricant into the tube.

In addition to one or more of the above disclosed features or as an alternate the method includes advancing the mandrel to the bend zone while injecting the first portion of atomizing medium into the tube.

In addition to one or more of the above disclosed features or as an alternate, the method includes injecting a second portion of lubricant into the tube through the mandrel head prior to, during, or after bending the tube and prior to retracting the mandrel.

In addition to one or more of the above disclosed features or as an alternate, the method includes injecting a second portion of atomizing medium into the tube through the mandrel head prior to, during, or after bending the tube and prior to retracting the mandrel.

In addition to one or more of the above disclosed features or as an alternate, the method includes injecting the second portion of atomizing medium into the tube after injecting the second portion of lubricant into the tube.

In addition to one or more of the above disclosed features or as an alternate, advancing and retracting the mandrel includes: moving the mandrel and holding stationary the tube; or holding stationary the mandrel and advancing the tube.

In addition to one or more of the above disclosed features or as an alternate the method includes clamping opposing ends of the tube when bending the tube.

In addition to one or more of the above disclosed features or as an alternate bending the tube includes forming a 180 degree bend in the tube.

BRIEF DESCRIPTION OF THE DRAWINGS

The following descriptions should not be considered limiting in any way. With reference to the accompanying drawings, like elements are numbered alike.

and

Figure 3:
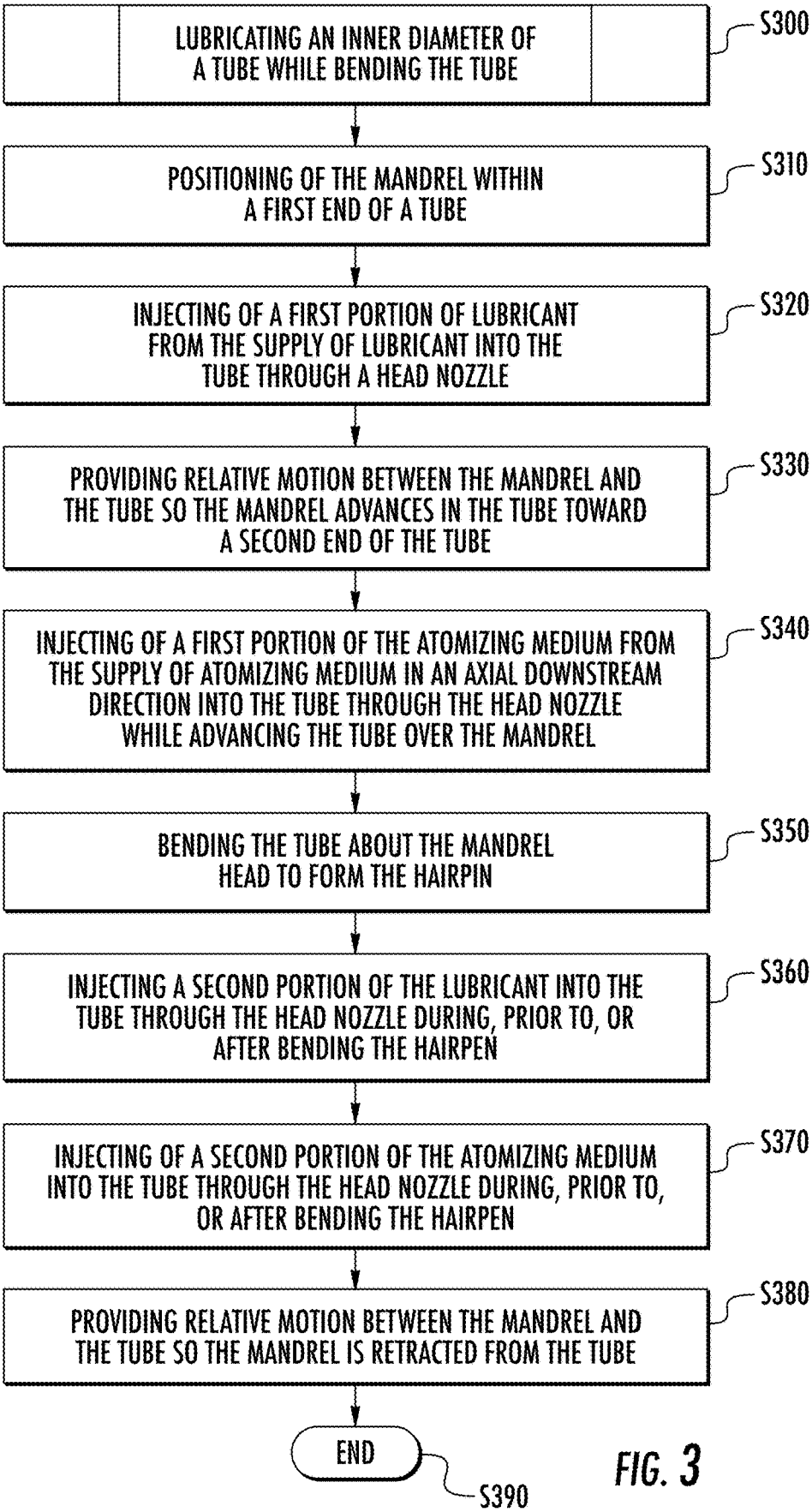
FIG. 3 illustrates a process performed by the disclosed embodiments.
Figure 4A:
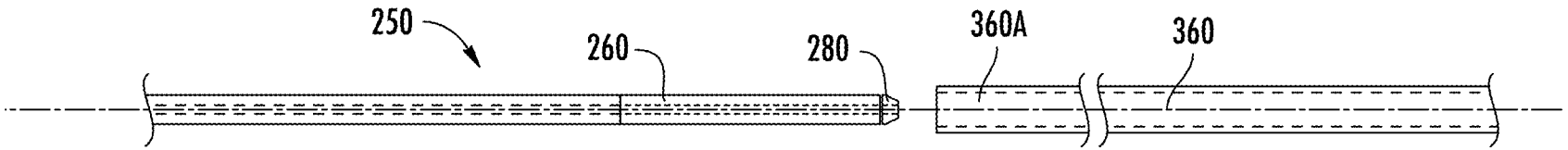
Figure 4B:
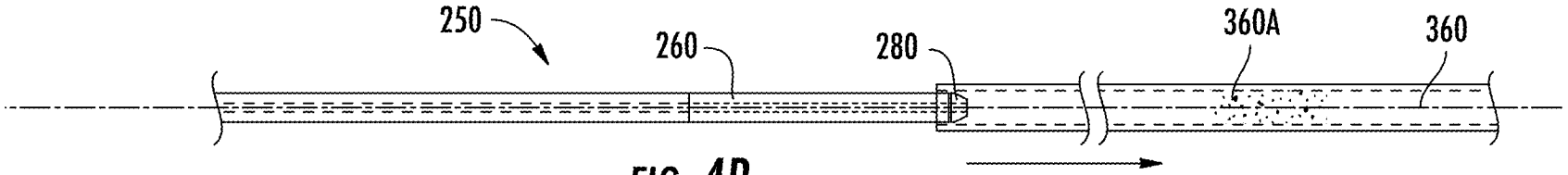
Figure 4C:
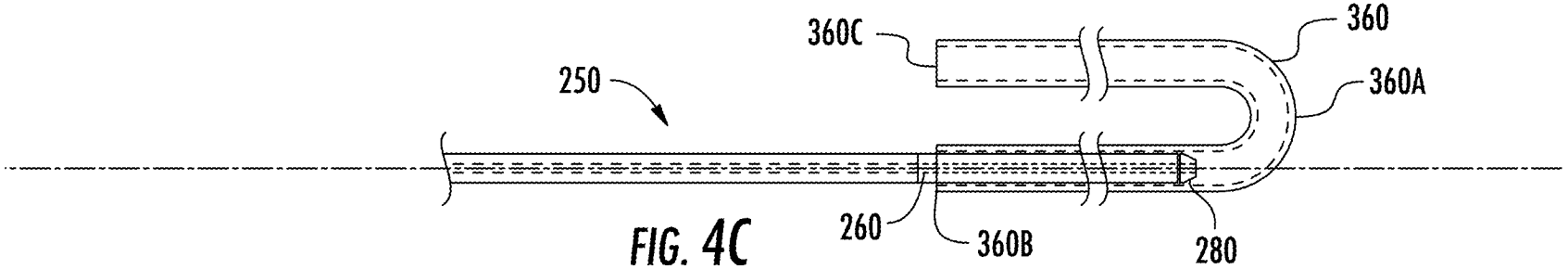

FIGS. 4A-4C illustrate configurations of the disclosed embodiments obtained during performance of the process illustrated in FIG. 3.

DETAILED DESCRIPTION

Figure 1:
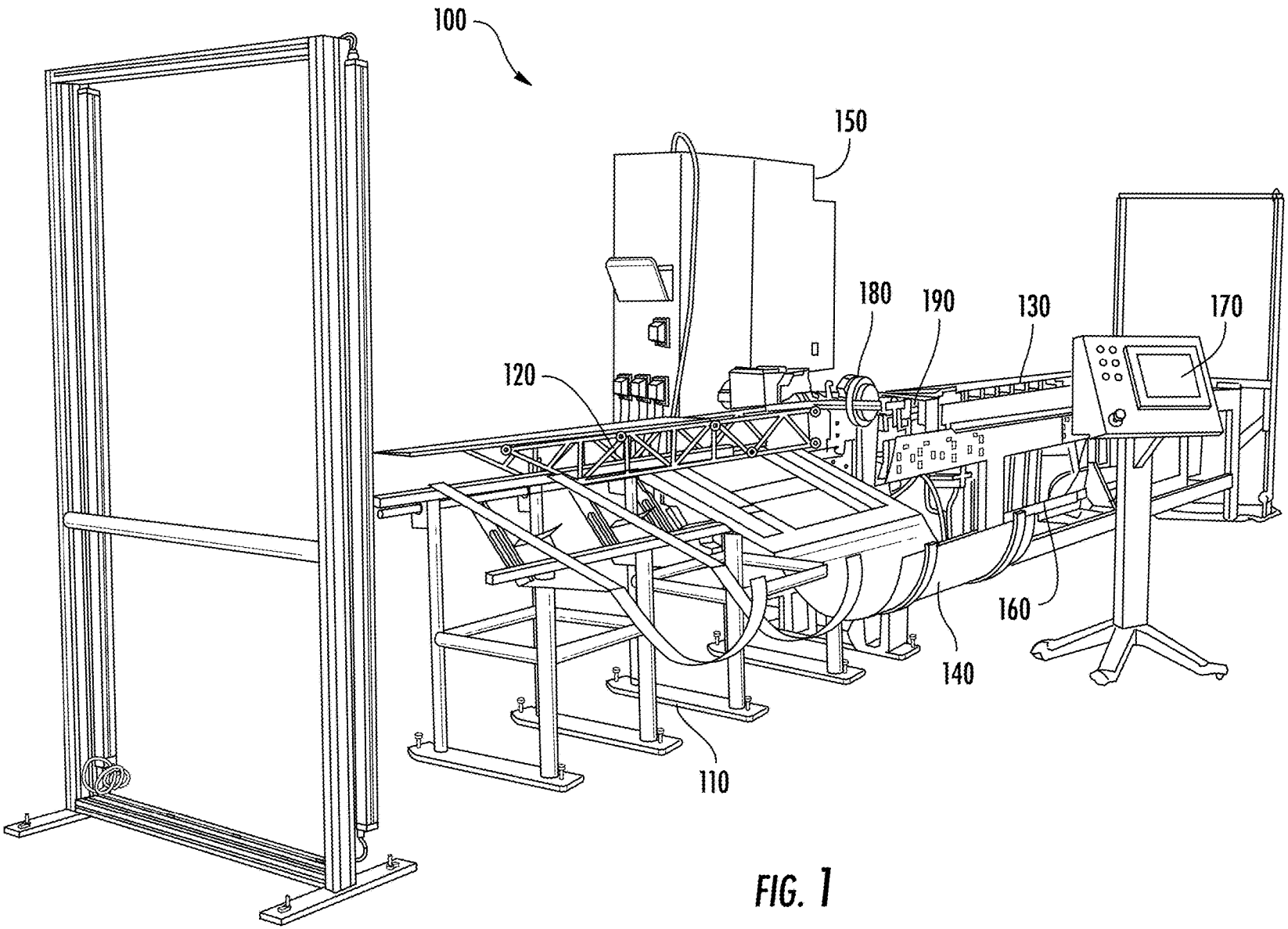
FIG. 1 illustrates a tube bending system according to an embodiment.

Referring now to the tube bending system 100 illustrated in FIG. 1 includes a table-like frame 110, guide tubes 120 and a conveyer 130 mounted on the frame 110 and extend generally parallel to a longitudinal axis. A receiving bin 140 is provided to receive formed hairpin tubes. System electronics 150 and pneumatics 160 are provided which may be controlled by a controller 170. A bend wheel 180 and a tube clamp 190 are provided, and the clamp 190 may be automated or manually operated.

Figure 2:
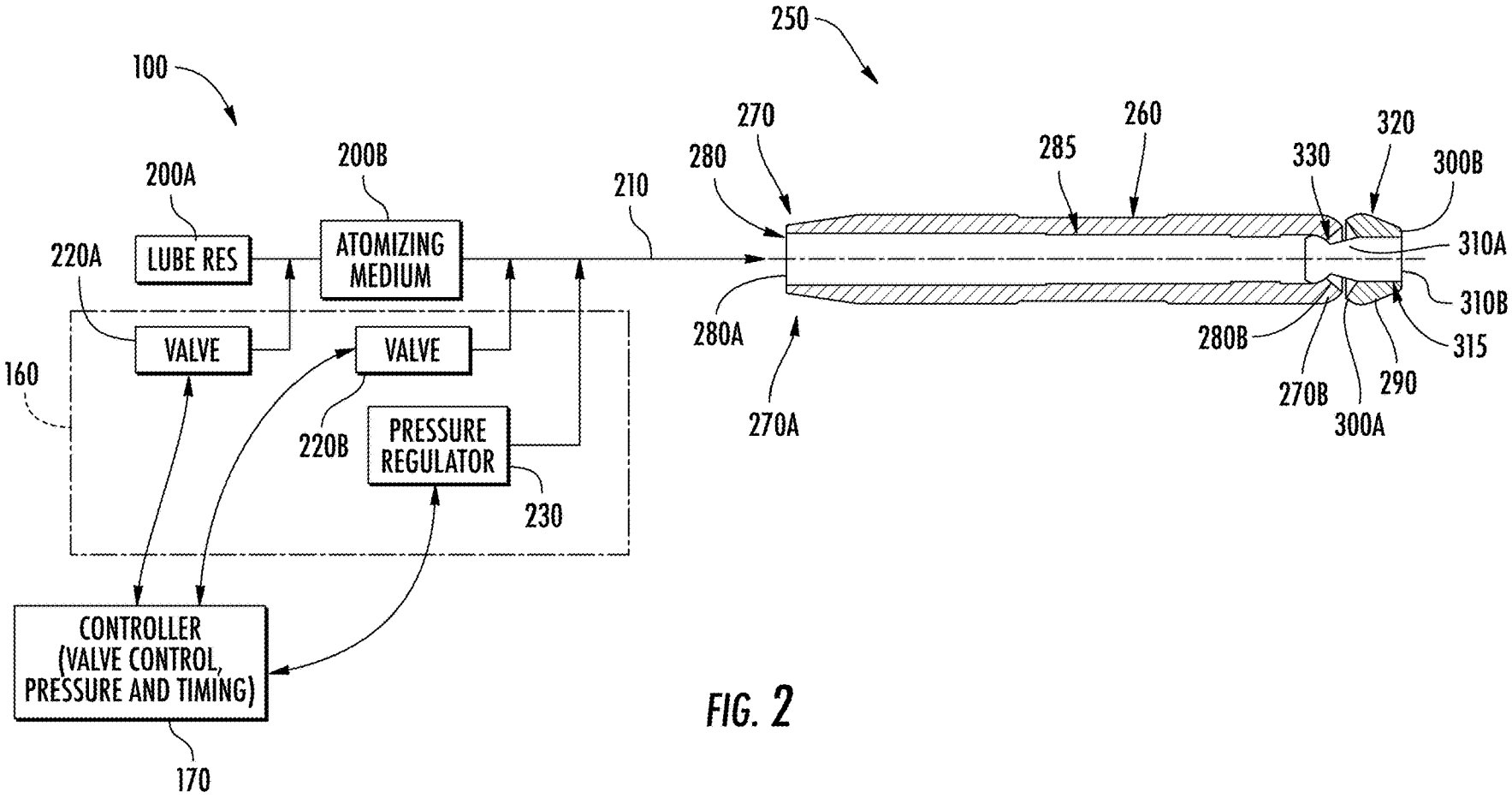
FIG. 2 further illustrates a tube bending system according to an embodiment.

Turning to FIG. 2, system includes a plurality of reservoirs 200 including a first reservoir 200A storing a supply of lubricant and a second reservoir 200B storing an atomizing medium. The plurality of reservoirs 200 may be fluidly connected by tubing 210 to the system pneumatics 160. The pneumatics 160 may include a plurality of valves 220 including a first valve 220A fluidly controlling flow from the first reservoir 200A and a second valve 220B fluidly controlling flow from the second reservoir 200B. The plurality of valves 220 may be controlled by the controller 170. A pressure regulator 230 is provided for the system to monitor may be controllable to provide pressure regulation for the system pneumatics 160 and during system operation.

The system may include a bend mandrel 250. The bend mandrel 250 may include a mandrel body 260 having a first pair of opposing axial ends 270 including a first upstream end 270A and a first downstream end 270B. The first pair of opposing axial ends 270 may include a respective first pair of axially aligned orifices 280 at opposing ends of a first fluid passage 285, including a first upstream orifice 280A and a first downstream orifice 280B.

A mandrel head 290 has a second pair of opposing axial ends 300 including a second upstream end 300A connected to the first downstream end 270B of the mandrel body 260, and a second downstream end 300B. The second pair of opposing axial ends 300 include a respective second pair of axially aligned orifices 310 at opposing ends of a second fluid passage 315, including a second upstream orifice 310A and a second downstream orifice 310B. The second orifice 310B forms an output nozzle for the mandrel head 290.

In one embodiment the mandrel head 290 is tapered so that a diameter at the downstream end 300B is smaller than at the upstream end 300A. In one embodiment the mandrel head 280 has an arc shaped profile for an outer surface 320 that is substantially spherical between the upstream end 300 and the downstream end 300B, and the second pair of opposing ends 310 are planar. The mandrel head 290 may swivel relative to the mandrel body 260.

A connecting tube 330 may extend between, and fluidly connect, the mandrel head 290 and the mandrel body 260. The first downstream orifice 270B may be tapered whereby the connecting tube swivels 330 against the mandrel body 260 to swivel the mandrel head 290 therewith.

Turning to FIGS. 3 and 4A-4C, a process S300 is illustrated, executed by the controller 170, for lubricating an inner surface of a tube 360 while bending the tube 360 for example at a bend zone 360A. The controller 170 executes step S310 of controlling a positing of the mandrel 250 within a first end 360A of the tube (FIG. 4A). For example the tube is moved by the conveyer 130 relative to the mandrel 250. At this time, the tube 360 may be held with the clamp 190 at or near the bending wheel 180. At step S320 the controller 170 controls an injection of a first portion of lubricant from the reservoir of lubricant 280 into the tube 360 through the downstream orifice 310B in the mandrel head 290, toward a downstream end of the tube 360C. For example, the first valve opens 220A to provide the first portion of lubricant from the first reservoir 200A.

At step S330 the controller again controls advancing the mandrel 250 into the tube 360 toward a second end of the tube 360C (FIG. 4B), the second end being the downstream end, to thereby position a mandrel head 290 at the bend zone 360A in the tube. In one embodiment the tube 360 moves relative to the mandrel 250, which remains stationary. The motion between the mandrel 250 and the tube 360, however, is relative motion so that the present disclosure is not intending to require movement of one of the mandrel 250 and the tube 360 while requiring the other to remain stationary. The bend zone 360A may be, for example, a predetermined distance from the upstream end 360B of the tube 360. At step S340 the controller controls an injection of a first portion of atomizing medium from the supply of atomizing medium into the tube 360 through the mandrel head 290 while the mandrel 250 advances relative to the tube 360 to become further inserted into the tube 360, that is, so that the tube advances 360 over the mandrel 250. For example, the second valve 220B opens to provide the first portion of atomizing medium from the second reservoir 200B.

At step S350 the controller controls bending the tube about the mandrel head to form the hairpin (FIG. 4C). For example, the tube 360 is bent around the bend wheel 180 to form a one hundred and eighty degree bend. At step S360 the controller controls injecting a second portion of lubricant into the tube 360 through the mandrel head 290. Such second portion of lubricant may be injected during, prior to, or after controlling the bending of the tube 360. For example, the first valve opens 220A to provide the second portion of lubricant from the first reservoir 200A.

At step S370 controlling an injection of a second portion of the atomizing medium into the tube through the mandrel head 290 the after controlling the injection of the second portion of lubricant. For example, the second valve 220B opens to provide the second portion of atomizing medium from the second reservoir 200B. The lubricant is thus dispersed about the remainder of the interior surface of the tube.

At step S380 the controller controls relative motion between the mandrel 250 and the tube 360 to retract the mandrel 250 from the tube 360. At step S390 the process that began at step S300 ends. Benefits of the disclosed embodiments include an improved quality of dispersing lubricant within a tube and an improved control over lubrication location and amount within the tube.

As described above, embodiments can be in the form of processor-implemented processes and devices for practicing those processes, such as a processor, which may be a programmable logic controller (PLC). Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A tube bending system for forming a hairpin tube, the tube bending system comprising:

a supply of lubricant;

a supply of atomizing medium;

a bend mandrel, the bend mandrel comprising:

a mandrel body having a first pair of opposing axial ends including a first upstream end and a first downstream end, the first pair of opposing axial ends including a respective first pair of axially aligned orifices at opposing ends of a first fluid passage, including a first upstream orifice and a first downstream orifice, and a mandrel head having a second pair of opposing axial ends including a second upstream end connected to the first downstream end of the mandrel body, and a second downstream end, the second pair of opposing axial ends including a respective second pair of axially aligned orifices at opposing ends of a second fluid passage, including a second upstream orifice and a second downstream orifice, the second downstream orifice forming an output nozzle for the mandrel head, a connecting tube extending between, and fluidly connecting, the mandrel head and the mandrel body, the first downstream orifice being tapered whereby the connecting tube swivels against the mandrel body to swivel the mandrel head therewith, the mandrel head being positionable within a length of a tube to be bent, the mandrel is configured for injecting lubricant into the tube via the second downstream orifice.

2. The system of claim 1, comprising a system controller configured for:

controlling a position of the mandrel disposed within a first end of the tube, the first end being an upstream end;

controlling an injection of a first portion of lubricant from the supply of lubricant into the tube through the mandrel head;

controlling motion of the mandrel or the tube so that the mandrel advances into the tube toward a second end of the tube, the second end being a downstream end, to thereby position the mandrel head at a bend zone in the tube; and controlling a bending of the tube about the mandrel head to form the hairpin; and controlling a retraction of the mandrel from the tube.

3. The system of claim 2, wherein the controller is further configured for:

controlling an injection of a first portion of atomizing medium into the tube from the mandrel head before controlling the bending of the tube.

4. The system of claim 3, wherein the controller is further configured for:

controlling the injection of the first portion of atomizing medium while controlling the advancement of the mandrel into the tube.

5. The system of claim 4, wherein the controller is further configured for:

controlling an injection of a second portion of lubricant into the tube through the mandrel head at least after controlling the bending of the tube and prior to controlling the retraction of the mandrel.

6. The system of claim 5, wherein the controller is further configured for:

controlling an injection of a second portion of atomizing medium into the tube through the mandrel head after controlling the injection of the second portion of lubricant into the tube and prior to controlling the retraction of the mandrel.

7. The system of claim 6, wherein the controller is configured for controlling the advancement and retraction of the mandrel by:

controlling a movement of the mandrel or the tube so that the mandrel moves relative to the tube; or controlling movement of the tube about the mandrel while the mandrel is fixedly positioned.

8. A method of forming a hairpin tube for a heat exchanger with the tube bending system of claim 1, the method comprising:

positioning the mandrel head of the mandrel within a first end of a tube, the first end being an upstream end of the tube;

injecting a first portion of lubricant axially into the tube through the mandrel head;

advancing the mandrel into the tube toward a second end of the tube, the second end being a downstream end, to thereby position the mandrel head at a bend zone in the tube; and bending the tube about the mandrel head to form the hairpin.

9. The method of claim 8, further comprising:

controlling motion of the mandrel or the tube so that mandrel is retracted from the tube.

10. The method of claim 9, comprising:

injecting a first portion of atomizing medium into the tube from the mandrel head before bending the tube.

11. The method of claim 10, comprising:

injecting the first portion of atomizing medium into the tube after injecting the first portion of lubricant into the tube.

12. The method of claim 11, comprising:

advancing the mandrel to the bend zone while injecting the first portion of atomizing medium into the tube.

13. The method of claim 12, comprising:

injecting a second portion of lubricant into the tube through the mandrel head at least after bending the tube and prior to retracting the mandrel.

14. The method of claim 13, comprising:

injecting a second portion of atomizing medium into the tube through the mandrel head prior to, during, or after bending the tube and prior to retracting the mandrel.

15. The method of claim 14, comprising:

injecting the second portion of atomizing medium into the tube after injecting the second portion of lubricant into the tube.

16. The method of claim 15, wherein advancing and retracting the mandrel includes:

moving the mandrel and holding stationary the tube; or holding stationary the mandrel and advancing the tube.

17. The method of claim 16, including clamping opposing ends of the tube when bending the tube.

18. The method of claim 17, wherein bending the tube includes forming a 180 degree bend in the tube.

* * * * *